United States Patent [19]

Pinck et al.

[11] 4,320,773

[45] Mar. 23, 1982

[54] METHOD AND APPARATUS FOR TREATING WRAPPING MATERIAL FOR CIGARETTES OR THE LIKE

[75] Inventors: Peter Pinck, Gross-Hansdorf; Uwe Heitmann, Hamburg; Anton Baier, Wentorf; Adolf Helms, Hamburg, all of Fed. Rep. of Germany

[73] Assignee: Hauni-Werke Körber & Co. KG., Hamburg, Fed. Rep. of Germany

[21] Appl. No.: 179,687

[22] Filed: Aug. 20, 1980

[30] Foreign Application Priority Data

Aug. 23, 1979 [DE] Fed. Rep. of Germany ..... 2934044

[51] Int. Cl.[3] ..... A24C 5/60

[52] U.S. Cl. ..... 131/281; 219/384; 131/365

[58] Field of Search ..... 131/21 R, 15 R, 23 R, 131/281, 365; 219/384

[56] References Cited

U.S. PATENT DOCUMENTS

| | | | |
|---|---|---|---|
| 2,763,759 | 9/1956 | Mito et al. | 219/384 |
| 3,862,396 | 1/1975 | Machida et al. | 219/384 |
| 4,040,425 | 8/1977 | Goodling et al. | 219/384 |
| 4,207,458 | 6/1980 | Lilly et al. | 219/384 |
| 4,219,727 | 8/1980 | Bolt | 131/281 |
| 4,232,574 | 11/1980 | Hall | 131/336 |
| 4,236,062 | 11/1980 | Lilly et al. | 131/281 |
| 4,253,010 | 2/1981 | Brown et al. | 219/384 |

*Primary Examiner*—V. Millin

*Attorney, Agent, or Firm*—Kontler & Grimes

[57] ABSTRACT

A running web of wrapping material which is about to be converted into adhesive-coated uniting bands for joining plain cigarettes with filter plugs in filter tipping machines is transported through the passage of a housing wherein the web travels through a series of spark gaps between pairs of spaced-apart electrodes. The sparks which are caused to jump across the gaps perforate the web with attendant development of ozone and particles of dust. The passage of the housing forms part of an endless path for the circulation of Argon which reduces the rate of development of ozone, which is cooled to cool the electrodes, and which is caused to pass through a filter serving to intercept the particles of dust which are removed from the spark gaps. The making of holes in a noble-gas atmosphere prolongs the useful life of the electrodes.

23 Claims, 4 Drawing Figures

METHOD AND APPARATUS FOR TREATING WRAPPING MATERIAL FOR CIGARETTES OR THE LIKE

BACKGROUND OF THE INVENTION

The present invention relates to a method and apparatus for treating cigarette paper, imitation cork or other types of wrapping material for cigarettes or analogous rod-shaped articles which constitute or form part of smokers' products in a machine which manufactures or processes such products. More particularly, the invention relates to improvements in a method and apparatus for making holes in strips, webs or sheets of wrapping material for cigarettes, filter rod sections or like rod-shaped articles by resorting to a perforating device which is installed in a producing or processing machine and perforates the wrapping material by generating sparks between first and second electrodes. A perforating device which can be used to make holes in wrapping material for cigarettes or the like is disclosed, for example, in commonly owned copending patent application Ser. No. 003,364 filed Jan. 15, 1979 by Anton Baier, now U.S. Pat. No. 4,247,754 granted Jan. 27, 1981.

The purpose of making holes in the wrappers of cigarettes or like rod-shaped articles which constitute or form part of smokers' products is to allow penetration of a certain amount of atmospheric air into the column of tabacco smoke. It is believed that the admixture of fresh atmospheric air to tobacco smoke reduces the deleterious effects of nicotine and/or condensate. Perforating devices which are used to make holes in cigarette paper, artificial cork or like wrapping material can employ needles or analogous mechanical parts which simply penetrate through a running web or a finished wrapper without removing any material therefrom. It is also known to resort to laser beams which burn holes into the wrapping material as well as to employ sets of electrodes defining spark gaps through which the wrapping material is caused to pass whereby the sparks which jump across the gaps, when the electrodes receive high-voltage pulses from a suitable source, burn holes into the wrapping material. Such making of holes is accompanied by the development of dust particles, namely, fragments of wrapping material which must be removed from the spark gaps. Moreover, the formation of holes by resorting to spark gaps is accompanied by the development of substantial quantities of ozone which is detrimental to the health of attendants. Removal of ozone, prevention of development of appreciable quantities of ozone, as well as removal of particles of dust are desirable on the additional ground that this contributes to longer useful life of the electrodes. Therefore, the machine which embodies the perforating device need not be idled at frequent intervals for the sole purpose of inspecting, cleaning, repairing and/or replacing one or more electrodes. Each interruption of operation of a modern high-speed cigarette maker entails the loss of approximately 6000 cigarettes per minute so that the manufacturers of cigarettes are evidently interested in maintaining the machines in continuous operation during the entire shift and are even more interested in ensuring that the operation will not be interrupted on the sole ground that one or more electrodes of the perforating device (which, when compared with the cost of the entire machine, constitutes but a minor component of the cigarette maker) require inspection, repair or replacement.

The mounting of the perforating device directly in the machine which manufactures and/or processes cigarettes or other rod-shaped articles which constitute or form part of smokers' products is desirable and advantages because the operation of the perforating device can be regulated in immediate response to detection of rod-shaped articles with wrappers which exhibit excessive or insufficient permeability to the flow of air therethrough. Such immediate regulation would not be possible if the wrapping material were perforated at the plant where the wrapping material is made, i.e., at a locus which is remote from the machine for the making and/or processing of plain or filter tipped cigarettes, cheroots, cigarillos or cigars or filter rod sections.

OBJECTS AND SUMMARY OF THE INVENTION

An object of the invention is to provide a novel and improved method of treating webs of wrapping material for cigarettes or the like in such a way that, even though the treatment involves the development of dust and/or ozone, this does not adversely influence the useful life of sensitive components of the apparatus which is used for the practice of the method and/or the health of attendants.

Another object of the invention is to provide a novel and improved method of electrically perforating webs of cigarette paper or the like in such a way that the perforating operation is not harmful to the health and/or comfort of attendants in spite of the generation of dust and/or ozone.

A further object of the invention is to provide a method of the above outlined character which enables the electrodes of the perforating unit to stand longer periods of continuous use and to require less frequent inspection than in heretofore known units.

An additional object of the invention is to provide a method which can be practiced in connection with the making of holes in a wide variety of wrapping materials including cigarette paper, imitation cork, lightweight cardboard or the like.

A further object of the invention is to provide a novel and improved apparatus for the practice of the above outlined method.

Another object of the invention is to provide an apparatus which ensures that particles of dust which develop when a running web of wrapping material for cigarettes, filter rod sections and/or like rod-shaped articles which constitute or form part of smokers' products is perforated will not harm the attendants and/or adversely affect the useful life of component parts of the apparatus and/or contaminate the production line or machine in which the apparatus is installed.

An additional object of the invention is to provide an apparatus which, even though its component parts cause the development of ozone in the course of a perforating operation, is capable of preventing the developing ozone from adversely influencing the health of persons working in the area in which the apparatus is installed.

Another object of the invention is to provide an apparatus of the above outlined character which can be readily installed in existing machines or production lines for the mass-manufacture of cigarettes, filter rod sections and/or other rod-shaped articles constituting or forming part of smokers' products.

An ancillary object of the invention is to establish a satisfactory environment for the perforation of cigarette paper or other suitable wrapping material in an apparatus which relies for the making of holes on the generation of sparks by resorting to pairs of electrodes which receive high-voltage pulses.

Another object of the invention is to provide an apparatus which can be used with advantage in high-speed machines for the production of cigarettes or other rod-shaped smokers' products at the rate of up to and even well in excess of 100 per second.

One feature of the invention resides in the provision of a method of treating wrapping material for rod-shaped articles which constitute or form part of smokers' products. More particularly, one feature of the invention resides in the provision of a method of treating wrapping material in a machine or production line for the manufacture and/or processing of smokers' products. The method comprises the steps of establishing at least one spark gap between first and second electrodes, introducing the wrapping material into the spark gap whereby the sparks between the first and second electrodes perforate the wrapping material and entail the development of dust particles, establishing an at least substantially closed path which includes the spark gap and is at least substantially sealed from the surrounding atmosphere, filling the path with a gaseous fluid which counteracts the development of ozone as a result of generation of sparks across the spark gap, circulating the gaseous fluid along the path whereby the fluid entrains the particles of dust from the region of the spark gap, and intercepting the entrained particles of dust in a portion of the path which is located downstream of the gap, as considered in the direction of circulation of the gaseous fluid, so that the fluid which flows from the just mentioned portion of the path toward the spark gap is at least substantially free of dust particles.

The method preferably further comprises the step of cooling the gaseous fluid in the path so that the fluid which flows toward the spark gap removes heat from the electrodes.

The fluid is preferably a noble gas, e.g., Argon. In order to prevent penetration of atmospheric air into the closed path, the fluid in such path is preferably maintained at a pressure which at least slightly exceeds atmospheric pressure. Since at least some leakage of fluid from the closed path into the surrounding atmosphere is unavoidable or can be avoided only at a substantial cost, the method preferably further comprises the step of admitting gaseous fluid into the closed path at a rate which suffices to compensate for the leakage. To this end, the closed path can be connected with a source of gaseous fluid (e.g., a bottle for highly pressurized noble gas) by way of suitable conduits which contain one or more pressure gauges, flow restrictors, pressure regulating valves and/or other constituents of a system for controlled admission of gaseous fluid into an endless path.

The wrapping material is preferably transported through the gap in a predetermined direction, and the aforementioned circulating step preferably includes conveying the gaseous fluid in the region of the spark gap or gaps in such a way that the fluid flows in parallelism with (in or counter to) the direction of advancement of the wrapping material. The wrapping material may constitute a continuous web which is subdivided into discrete sections of predetermined length (e.g., into so-called uniting bands which are used in filter tipping machines) upon completion of the perforating step. The wrapping material may be a web or tape of cigarette paper, imitation cork, lightweight cardboard or any other suitable strip or sheet stock for confining the fillers of plain or filter tipped cigarettes, cheroots, cigarillos or cigars or filter rod sections.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
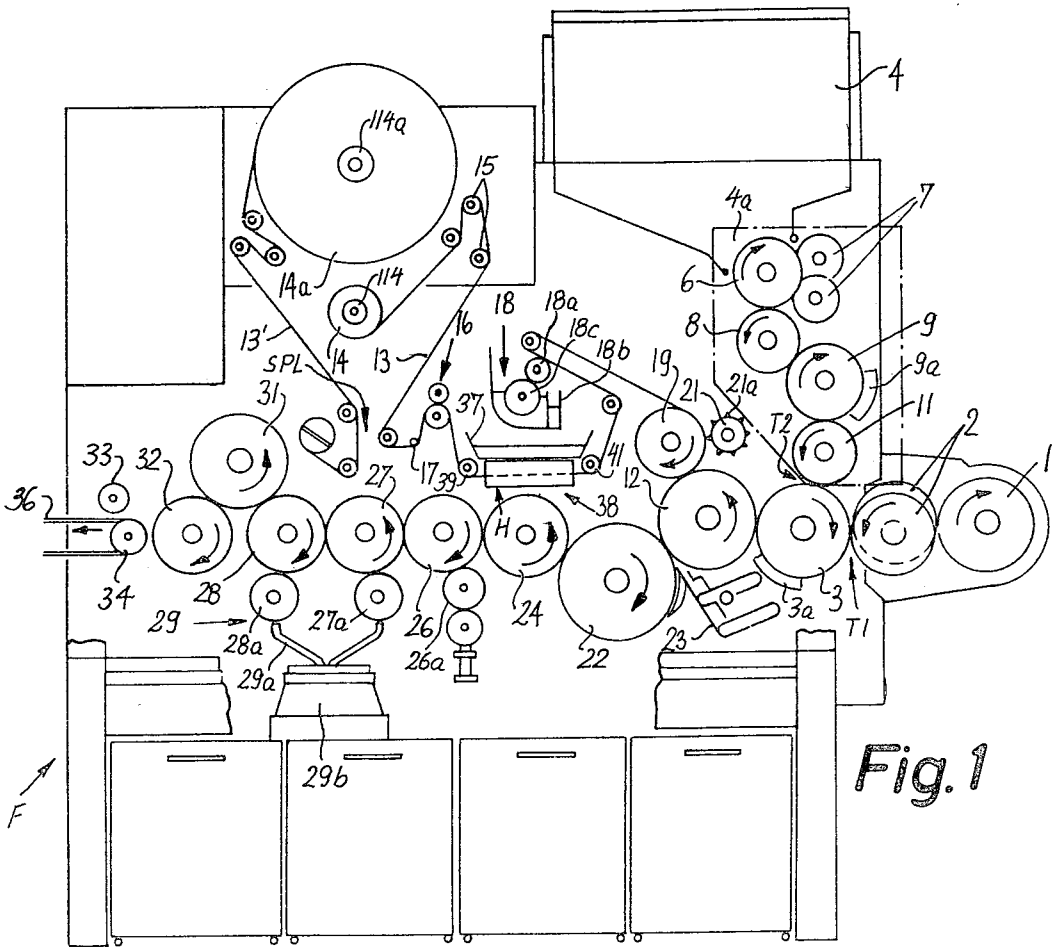
FIG. 1 is a schematic front elevational view of a filter tipping machine including an apparatus which embodies the present invention and is used to make perforations in a web of uniting band material.

Referring first to FIG. 1, there is shown a filter tipping machine of the type known as MAX S which is manufactured and sold by the assignee of the present application. The construction of the filter tipping machine, which is directly coupled to a cigarette making machine (for example, a machine known as SE 80 manufactured and sold by the assignee of the present application) is as follows:

The frame F of the filter tipping machine supports a rotary drum-shaped conveyor 1 which can be said to form part of the aforementioned cigarette making machine and delivers two rows of plain cigarettes of unit length to a pair of staggered rotary drum-shaped aligning conveyors 2. The plain cigarettes of one row of cigarettes in the axially parallel peripheral flutes of the row forming conveyor 1 are adjacent to one axial end, and the plain cigarettes of the other row are adjacent to the other axial end of this conveyor. Furthermore, the cigarettes of one row are transported by oddly numbered flutes whereas the cigarettes of the other row are transported by the evenly numbered flutes of the conveyor 1. The two rows of cigarettes are transferred into the peripheral flutes of the corresponding aligning conveyors 2 which rotate in a counterclockwise direction, as viewed in FIG. 1, and are driven at different speeds or transport the respective cigarettes through different distances so that, when a flute of the front aligning conveyor 2, as viewed in FIG. 1, reaches a transfer station T1, it is an accurate axial alignment with a flute of the rear aligning conveyor 2. Such flutes deliver a pair of coaxial plain cigarettes of unit length into the adjacent flute of a rotary drum-shaped assembly conveyor 3 which is driven to rotate in a clockwise direction, as viewed in FIG. 1.

The top portion of the frame F supports a magazine 4 for a supply of parallel rod-shaped filter rod sections (not specifically shown) of six times unit length. The outlet opening 4*a* at the lower end of the magazine 4 receives a portion of a rotary drum-shaped serving conveyor 6 which is driven to rotate in a clockwise direction, as viewed in FIG. 1, and has peripheral flutes extending in parallelism with its axis. Such flutes remove discrete filter rod sections of six times unit length from the magazine 4 and transport successive filter rod sections past two rotary disc-shaped knives 7 which rotate about parallel axes and are staggered with respect to each other, as considered in the axial direction of the severing conveyor 6. The conveyor 6 cooperates with the knives 7 to convert successive filter rod sections of six times unit length into sets of three coaxial filter plugs of double unit length, and the filter plugs of successive sets are transferred onto a rotary staggering conveyor 8. The conveyor 8 is assembled of three discs which may but need not rotate about a common axis and are driven at different speeds and/or transport the respective filter plugs through different distances so that the filter plugs of each set are staggered with respect to each other, as considered in the circumferential direction of the conveyor 8, prior to transfer of successive filter plugs of double unit length into successive peripheral flutes of a rotary drum-shaped shuffling conveyor 9. The conveyor 9 is driven to rotate in a clockwise direction, as viewed in FIG. 1, and cooperates with two stationary cams 9*a* (only one shown) to convert the single row of axially staggered filter plugs into a row wherein each preceding filter plug is in accurate alignment with the next-following plug prior to transfer of successive plugs of the thus obtained row into successive flutes of a combined accelerating and inserting conveyor 11. The conveyor 11 is a rotary drum whose flutes deliver filter plugs of double unit length into successive flutes of the assembly conveyor 3 at a second transfer station $T_2$ which is located upstream of the transfer station $T_1$. The pairs of plain cigarettes of unit length which are delivered into the flutes of the assembly conveyor 3 at the transfer station $T_1$ are spaced apart from each other by a distance which at least equals the axial length of a filter plug of double unit length, and the inserting conveyor 11 delivers filter plugs into successive flutes at the station $T_2$ in such positions that, upon arrival at the transfer station $T_1$, the filter plugs are located in the gaps between the corresponding plain cigarettes of unit length. The assembly conveyor 3 advances the thus obtained groups of three coaxial rod-shaped articles each through the space between two suitably configurated condensing cams 3*a* (only one shown) which cause the plain cigarettes to move axially toward each other and into abutment with the respective end faces of the corresponding filter plug of double unit length.

The assembly conveyor 3 delivers successive condensed groups (each such group contains two coaxial plain cigarettes of unit length and a filter plug of double unit length therebetween) into successive flutes of a rotary drum-shaped transfer conveyor 12. This conveyor further receives adhesive-coated uniting bands from a rotary drum-shaped suction conveyor 19 which cooperates with the blades 21*a* of a rotary cutter 21.

The uniting bands are obtained in the response to severing of the leader of a continuous web 13 of cigarette paper, imitation cork or another suitable flexible strip-shaped wrapping material. Such material is drawn off a reel 14 which is mounted on a spindle 114 and is caused to travel around a plurality of guide rolls 15 prior to reaching a so-called curling device 17 of the type disclosed in commonly owned U.S. Pat. No. 3,962,957 granted June 15, 1976 to Alfred Hinzmann. After advancing beyond the curling device 17, successive increments of the web 13 enter the nip of two advancing rolls 16 at least one of which is driven to advance the web in a direction toward a deflecting roll 39. The leader of the web 13 adheres to the foraminous peripheral surface of the rotary suction conveyor 19 and is caused to advance past successive blades 21*a* of the rotating cutter 21. The latter cooperates with the conveyor 19 to convert the web 13 into a series of web portions or uniting bands of predetermined length. The conveyor 19 draws the web 13 from the deflecting roll 39 and transports the web through the housing H of an apparatus 38 which embodies the present invention, around a deflecting roll 41, and along the applicator roll 18*a* of a paster 18 which coats one side of the web 13 with a suitable adhesive. The roll 18*a* receives adhesive from a tank 18*b* by way of a withdrawing roll 18*c* and coats a portion of or the entire underside of the travelling web 13. A trough 37 which intercepts droplets of adhesive is disposed between the tank 18*b* and the housing H of the apparatus 38.

The conveyor 19 applies successive discrete uniting bands to successive groups of coaxial rod-shaped articles in the oncoming flutes of the transfer conveyor 12. The uniting bands are preferably applied in such a way that they are disposed substantially tangentially of the respective groups and adhere to the corresponding filter plugs as well as to the innermost portions of the respective plain cigarettes of unit length. Such groups, each of which carries an adhesive-coated uniting band, are thereupon transferred onto the peripheral surface of a rotary drum-shaped wrapping conveyor 22 which cooperates with an adjustable (stationary or mobile) rolling device 23 to convolute the oncoming uniting bands around the respective groups so that each group constitutes a filter cigarette of double unit length.

The wrapping conveyor 22 delivers successive filter cigarettes of double unit length into successive flutes of a rotary drum-shaped drying conveyor 24 which can embody or is associated with suitable testing means for detection of filter cigarettes having defective wrappers. At least those filter cigarettes of double unit length whose wrappers are satisfactory are thereupon delivered into successive flutes of a rotary drum-shaped severing conveyor 26 which cooperates with a rotary disk-shaped knife 26*a* to sever each filter cigarette of double unit length midway across its filter plug so that each such cigarette yields two coaxial filter cigarettes of unit length. Each filter cigarette of unit length contains a plain cigarette of unit length, a filter plug of unit length, and one-half of a convoluted tubular uniting band which binds the filter plug to the respective plain cigarette.

The severing conveyor 26 delivers successive pairs of filter cigarettes of unit length into successive flutes of a rotary drum-shaped conveyor 27 of a turn-around device 29 of the type disclosed in commonly owned U.S. Pat. No. 3,583,546 granted to Gerhard Koop. The turn-around device 29 further comprises a second rotary drum-shaped fluted conveyor 27*a* which receives one filter cigarette of each pair from the conveyor 27, a third rotary drum-shaped fluted conveyor 28 which receives the other filter cigarette of each pair from the conveyor 27, a fourth rotary drum-shaped fluted conveyor 28*a*, and a set of orbiting arms 29*a* which receive motion from a driving unit 29*b*.

The operation of the turn-around device 29 is as follows: The conveyor 27 receives pairs of coaxial filter cigarettes of unit length from successive flutes of the severing conveyor 26. One filter cigarette of each pair is delivered into the oncoming flute of the conveyor 28, whereas the other filter cigarette of each pair enters the oncoming flute of the conveyor 27*a*. Successive flutes of the conveyor 27*a* deliver the respective filter cigarettes of unit length to oncoming arms 29*a* which turn each filter cigarette end-for-end and deliver the inverted cigarettes into successive flutes of the conveyor 28*a*. The conveyor 28*a* delivers the inverted filter cigarettes of unit length into alternate flutes of the conveyor 28. It is to be noted that the conveyor 27 delivers successive non-inverted filter cigarettes of unit length into alternate flutes of the conveyor 28 so that the latter provides room for acceptance of inverted cigarettes from the conveyor 28*a*. The arrangement is preferably such that the conveyor 28*a* delivers inverted filter cigarettes of unit length into the spaces between successive pairs of non-inverted cigarettes on the conveyor 28. Thus, the conveyor 28 transports a single file of aligned filter cigarettes of unit length in a clockwise direction, as viewed in FIG. 1, and the filter plugs of all filter cigarettes on the conveyor 28 face in the same direction. Successive flutes of the conveyor 28 deliver successive filter cigarettes of unit length to a testing conveyor 31 of conventional design, for example, of the type disclosed in commonly owned U.S. Pat. No. 3,962,906 granted June 15, 1976 to Uwe Heitmann et al. The cigarettes which are defective are segregated from satisfactory cigarettes on a rotary drum-shaped conveyor 32 which follows the testing conveyor 31 and may cooperate with an additional testing device which monitors the tobacco-containing ends of successive cigarettes. The cigarettes which are found to be defective by the testing unit including the conveyor 31 and/or by the testing unit including the conveyor 32 are segregated during travel past an ejecting device (not shown) of any known design and the remaining (satisfactory) cigarettes of unit length are delivered onto the upper reach of an endless belt conveyor 36. The upper reach of the conveyor 36 cooperates with a braking roll 33 and this conveyor is trained over pulleys 34 of which only one is shown in FIG. 1. The upper reach of the conveyor 36 delivers satisfactory filter cigarettes of unit length into storage, directly to a packing machine, or into a reservoir system (e.g., a system of the type which is known as Resy and is manufactured and sold by the assignee of the present application).

The operation of the wrapping conveyor 22 and rolling device 23 will be understood upon perusal of the disclosure in commonly owned U.S. Pat. Nos. 3,483,873 or 3,527,234, both granted to Alfred Hinzmann.

The frame F further supports a spindle 114*a* for a fresh reel 14*a* of wrapping material 13' the leader of which is held at a splicing station SPL. When the supply of running web 13 on the reel 14 is nearly exhausted, a splicing device (not specifically shown) at the station SPL is actuated to attach the leader of the web 13' to the trailing portion of the web 13. A splicing device which can be used in the filter tipping machine of FIG. 1 is disclosed, for example, in commonly owned U.S. Pat. No. 3,730,811 granted May 1, 1973 to Hans-Joachim Wendt. The disclosures of all of the aforementioned commonly owned patents are incorporated herein by reference.

Figure 2:
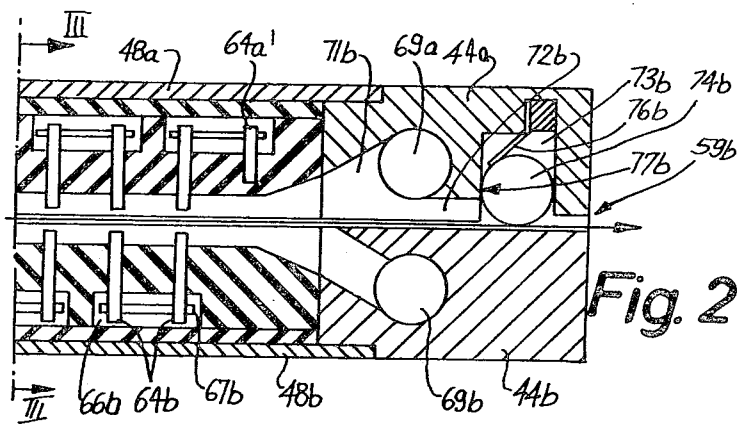
FIG. 2 is an enlarged fragmentary longitudinal vertical sectional view of a portion of the apparatus.
Figure 3:
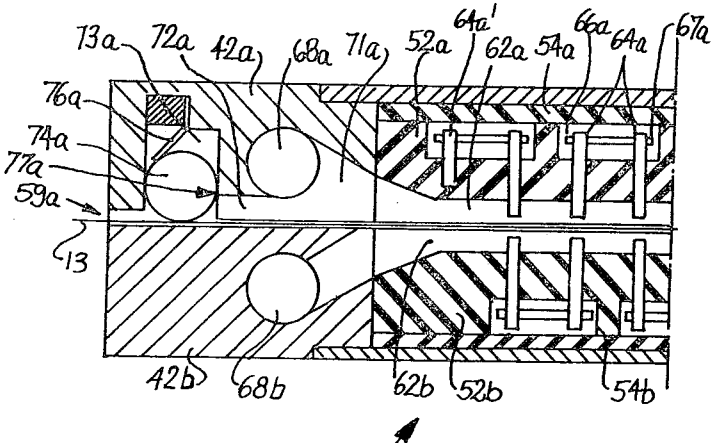
FIG. 3 is a transverse sectional view as seen in the direction of arrows from the line III—III of FIG. 2.
Figure 3:
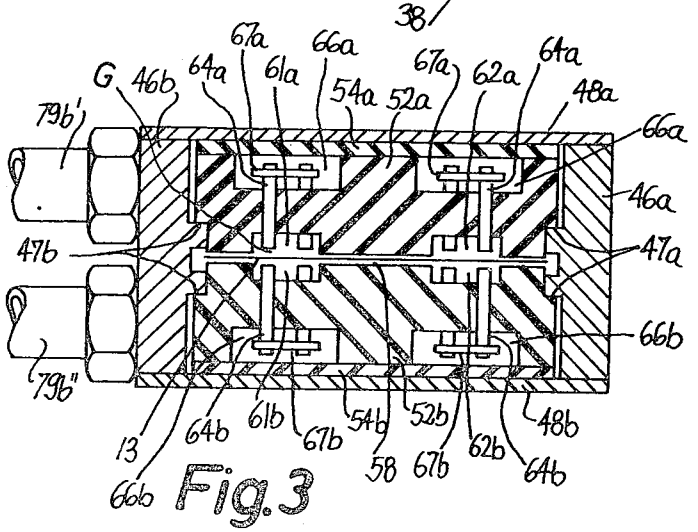
Figure 4:
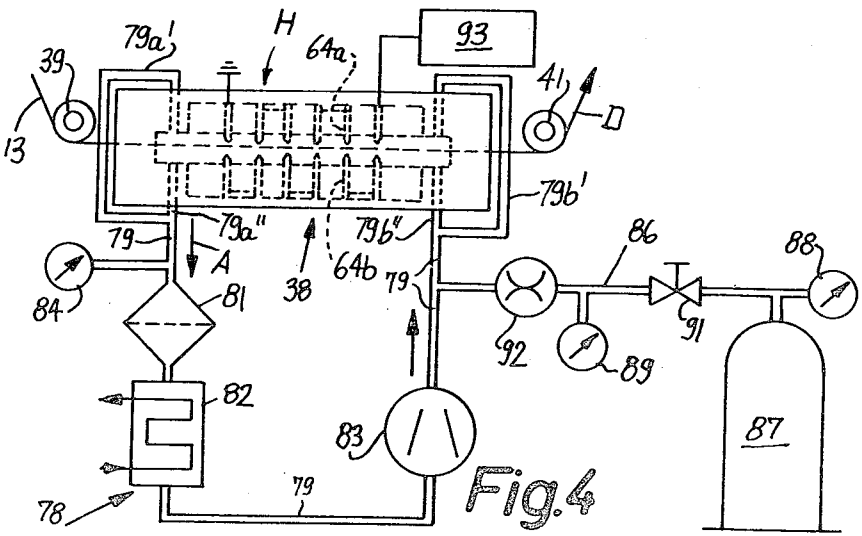
FIG. 4 is a diagrammatic elevational view of the entire apparatus including the source of gaseous fluid and the closed circuit for circulation of the gaseous fluid.

The improved apparatus 38 is shown in greater detail in FIGS. 2, 3 and 4. Referring first to FIG. 4, the apparatus 38 comprises the aforementioned housing H which is disposed between the deflecting rolls 39, 41 and defines an elongated passage for the running web 13 which advances in the direction of arrow D. The web 13 is perforated during travel through the housing H and thereupon advances toward the roller-shaped applicator 18*a* of the paster 18. The housing H contains first electrodes 64*a* and second electrodes 64*b*. These electrodes are disposed in pairs and define spark gaps G (see FIG. 3) through which the web 13 advances toward the deflecting roll 41.

The housing H comprises four block-shaped end portions 42*a*, 42*b*, 44*a*, 44*b*, two side walls 46*a*, 46*b*, and top and bottom walls 48*a*, 48*b*. The parts 42, 44, 46 and 48 are connected to each other by screws or other suitable fasteners means, not specifically shown. The interior of the housing H accommodates two electrode holders 52*a*, 52*b* which respectively carry the electrodes 64*a* and 64*b*. The holders 52*a*, 52*b* consist of ceramic or other suitable insulating material and include removable top and bottom plates 54*a*, 54*b* which preferably also consist of ceramic or other insulating material and are respectively adjacent to the walls 48*a*, 48*b*. It will be noted that, with the exception of the side walls 46*a*, 46*b*, the parts which are identified by similar reference numerals but are followed by characters a and b are respectively located above and below the plane of the web 13 in the interior of the housing H. The reference characters 47*a* and 47*b* denote two distancing members which hold the electrode holders 52*a*, 52*b* apart so that these holders define a horizontal slot 58 forming part of the aforementioned passage wherein the running web 13 advances from the inlet 59*a* of the housing H toward and through the outlet 59*b*. The inlet 59*a* and outlet 59*b* are respective adjacent to the deflecting rolls 39 and 41. As shown in FIG. 2, the inlet 59*a* is defined by the end portions 42*a*, 42*b* and the outlet 59*b* is defined by the end portions 44*a*, 44*b* of the housing H.

Those portions of the electrode holders 52*a*, 52*b* which are adjacent to the slot 58 are respectively provided with grooves or recesses 61*a*, 62*a* and 61*b*, 62*b* for the free inner end portions of the corresponding electrodes 64*a*, 64*b*. This can be readily seen in FIG. 3. The outer sides of the electrode holders 52*a*, 52*b* are respectively provided with circular sockets 66*a*, 66*b* for the outer end portions of the corresponding electrodes 64*a*, 64*b*. Each of the sockets 66*a*, 66*b* receives the outer end portions of two electrodes 64*a* or 64*b*, and the outer end portions of such pairs of electrodes are electrically as well as mechanically coupled to each other by clamps 67*a*, 67*b*. The two outermost electrodes 64*a'* of the upper row of electrodes, as viewed in FIG. 2, 3 or 4, merely serve for connection to a suitable source of high voltage. FIG. 2 shows that the inner end portions of the outermost electrodes 64*a'* do not extend into the slot 58, i.e., they do not form part of means for defining spark gaps.

The end portions 42*a*, 42*b*, 44*a*, 44*b* of the housing H are respectively provided with bores 68*a*, 68*b*, 69*a*, 69*b* for connection to the branches 79*a'*, 79*a''*, 79*b'*, 79*b''* of a pipe or conduit 79 which, together with the slot 58, defines an endless closed path 78 for the circulation of a gaseous fluid (preferably a noble gas, most preferably Argon) which is supplied, if and when necessary, from a source 87, e.g., a pressurized container connected to the pipe 79 by a supply conduit 86. The bores 68*a*, 68*b* and 69*a*, 69*b* respectively communicate with the slot 58 by way of channels 71*a*, 71*b* shown in FIG. 2. More specifically, the channels 71*a* and 71*b* communicate with the respective grooves 61*a*, 62*a* and 61*b*, 62*b*, i.e., each of these grooves is connected with two bores for admission or evacuation of gaseous fluid. Each of the grooves 61*a* defines with a groove 61*b* a chamber which is halved by the web 13 in the housing H. The same holds true for the grooves 62*a* and 62*b* (see FIG. 3).

The end portions 42*a*, 44*a* of the housing H are further formed with compartments 73*a*, 73*b* which communicate with the grooves 61*a* and 62*a* by way of channels 72*a*, 72*b*. The compartments 73*a*, 73*b* serve for reception of loosely inserted rotary members here shown as idler rollers 74*a*, 74*b* which are freely rotatable therein but are a sufficiently tight fit to furnish a satisfactory sealing action in the region of the inlet 59*a* and outlet 59*b* so that the latter cannot permit escape of gaseous fluid into the surrounding atmosphere or the flow of surrounding air into the slot 58. To this end, the rollers 74*a* and 74*b* are respectively biased by leaf springs 76*a*, 76*b* which are installed in the end portions 42*a*, 44*a* and urge the adjacent sealing rollers 74*a*, 74*b* against the surfaces 77*a*, 77*b* in the corresponding compartments 73*a*, 73*b* as well as against the adjacent end portions 42*b*, 44*b*, i.e., against the upper side of the web 13 which is thereby biased against the end portions 42*b*, 44*b* in such a way that friction between the web and the last mentioned end portions of the housing H is negligible (because the sealing rollers are rotatably by the running web).

The left-hand outermost electrode 64*a*′ of FIG. 4 is grounded and the right-hand outermost electrode 64*a*′ of FIG. 4 is connected with a source 93 of high-voltage pulses. Reference may be had to the aforementioned commonly owned U.S. Pat. No. 4,247,754 to Anton Baier. The pipe 79 contains a suitable gas filter 81 (e.g., a converter filter of the type used in automotive vehicles), a heat exchanger 82 which serves to cool the circulating gaseous fluid, and a pump 83 which circulates the fluid in the direction of the arrow, i.e., the pump draws the fluid through the heat exchanger 82. The heat exchanger 82 may resemble or may constitute a modified version of a radiator of the type used in automotive vehicles. That portion of the pipe 79 which extends through the heat exchanger 82 can be cooled by a blower (not specifically shown) which is driven by an electric motor or another suitable prime mover. The pump 83 may be a side-channel compressor type pump of known design. A pressure gauge 84 is installed to indicate the pressure of fluid medium which circulates along the path 78 defined by the housing H and pipe 79. A portion of path 78 (in the housing H), namely, the slot 58, is parallel to the direction of travel of the web 13 through the housing H of the apparatus 38.

The supply conduit 86 contains two pressure gauges 88 and 89 at the opposite sides of the connection between this conduit and the source 87. An adjustable pressure regulating valve 91 is mounted in the conduit 86 between the gauges 89 and 88. The conduit 86 further contains an adjustable flow restrictor 92 which is installed between the gauge 89 and the junction between the conduit 86 and pipe 79.

The electrodes of each row are connected in series. As mentioned above, the manner in which the electrodes are connected to the source 93 may be the same as disclosed in the commonly owned U.S. Pat. No. 4,247,754 to Baier. Reference may further be had to German Offenlegungsschrift No. 2,703,244 or to U.S. Pat. No. 4,025,742.

The operation of the apparatus 38 is as follows:

When the suction conveyor 19 draws the web 13 through the path portion or slot 58 of the housing H, the running web 13 drives the sealing rollers 74*a* and 74*b* which are yieldably biased by the leaf springs 76*a*, 76*b* so that they sealingly engage the surfaces 77*a*, 77*b* in the respective compartments 73*a*, 73*b* and also maintain the web 13 in sealing engagement with the end portions 42*b*, 44*b* of the housing H. Since the rollers 74*a*, 74*b* are in sealing contact with the upper side of the running web 13, the slot 58 is sealed from the surrounding atmosphere and, save for a certain amount of unavoidable leakage, the noble gas in the endless closed path 78 is effectively sealed from the surrounding atmosphere. The source 93 transmits high-voltage pulses at selected intervals to cause electric sparks to jump across the spark gaps G between the pairs of electroces 64*a*, 64*b*. Each such spark causes the formation of a hole in the running web 13. The sparks are developed seriatim between successive pairs of associated electrodes 64*a*, 64*b* in a manner as disclosed in the aforementioned U.S. Pat. No. 4,247,754 to Baier. Successive pairs of electrodes 64*a*, 64*b* are staggered with reference to each other, as considered transversely of the direction of travel of the web 13 through the housing H (this, too, is fully described and shown in the U.S. Pat. No. 4,247,754 to Baier), so that the running web is formed with several rows of holes, namely, with a discrete row of holes for each pair of electrodes 64*a*, 64*b*.

The pump 83 circulates a continuous stream of noble gas along the endless closed path 78 whereby the gas removes particles of dust from the region of the spark gaps G, i.e., from the grooves 61*a*, 61*b*, 62*a*, 62*b*, and thereby cools the electrodes 64*a*, 64*b*. The particles of dust which are entrained by the stream of noble gas are intercepted by the filter 81 downstream of the spark gaps G so that the gas which is thereupon cooled during flow through the heat exchanger 82 and returned into the housing H by the pump 83 is at least substantially free of dust particles.

The conduit 86 admits noble gas to the pipe 79 at such a rate as to compensate for losses due to leakage of noble gas into the surrounding atmosphere. The pressure regulating valve 91 is preferably set in such a way that the pressure of noble gas which fills the path 78 slightly exceeds atmospheric pressure. This ensures that air cannot penetrate into the path 78, i.e., the perforating operation takes place in a pure Argon atmosphere. This reduces the rate of development of ozone and protects the electrodes 64*a*, 64*b* by reducing the rate at which the electrodes are burned away. The electrodes are further protected due to the fact that the circulating noble gas cools their inner end portions and continuously removes particles of dust which develop as a result of the making of holes in the running web 13.

An important advantage of the improved method and apparatus is that gaseous fluid which circulates along the path 78 prolongs the useful life of the electrodes 64*a*, 64*b* and thus reduces the number of interruptions of operation of the machine in which the improved apparatus is intalled. Moreover, the apparatus ensures that the health of the attendants is not endangered by ozone which develops as a result of generation of sparks across the spark gaps G. Still further, interception of dust particles which are entrained by the stream of gaseous fluid in the path 78 ensures that the machine and/or the area around the machine is not contaminated with dust. Also, the operation of the apparatus is quite economical because the consumption of gaseous fluid (preferably noble gas and most preferably Argon) is minimal; this is due to the fact that the path 78 is at least substantially sealed from the surrounding atmosphere so that the extent of leakage of gaseous fluid into the surrounding air is negligible. As a rule, gaseous fluid is likely to leak at the inlet 59*a* and/or at the outlet 59*b* of the housing H. Such leakage is effectively reduced or prevented by the aforementioned arrangement of sealing rollers 74*a*, 74*b* and springs 76*a*, 76*b*. It is clear that other types of sealing means can be used with equal or similar advantage. The sealing rollers are installed in compartments (73*a*, 73*b*) which can be said to constitute upward extensions of the slot 58, i.e., of that portion of the endless closed path 78 which is defined by the housing H.

The improved apparatus can be used with equal advantage in cigarette making, filter rod making or other machines which turn out or process rod-shaped articles constituting or forming part of smokers' products.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of treating wrapping material for rod-shaped articles which constitute or form part of smokers' products in a machine for the manufacture and/or processing of such products, comprising the steps of establishing at least one spark gap between first and second electrodes; introducing the wrapping material into said spark gap whereby the sparks between the first and second electrodes perforate the wrapping material and entail the development of dust particles and ozone; establishing an endless path which includes the spark gap and is at least substantially sealed from the surrounding atmosphere; filling said path with a gaseous fluid which counteracts the development of ozone; circulating the gaseous fluid along said path whereby the fluid entrains the particles of dust from the region of said gap; and intercepting the entrained particles of dust in a portion of said path which is located downstream of said gap, as considered in the direction of circulation of gaseous fluid along said path, so that the fluid which flows from said portion of said path toward said spark gap is at least substantially free of dust particles.

2. The method of claim 1, further comprising the step of cooling the fluid in said path so that the fluid which flows toward said spark gap removes heat from the electrodes.

3. The method of claim 1, further comprising the step of maintaining the fluid in said path at a pressure which exceeds atmospheric pressure.

4. The method of claim 1, wherein said fluid is a noble gas.

5. The method of claim 4, wherein said noble gas is Argon.

6. The method of claim 1, wherein at least some leakage of said gaseous fluid takes place from said path into the surrounding atmosphere, and further comprising the step of admitting gaseous fluid into said path at a rate which suffices to compensate for said leakage.

7. The method of claim 1, further comprising the step of transporting the wrapping material through said spark gap in a predetermined direction, said circulating step including conveying the gaseous fluid in the region of said spark gap in substantial parallelism with said predetermined direction.

8. The method of claim 1, further comprising the steps of transporting a continuous web of wrapping material through said spark gap and thereupon subdividing the web into discrete web portions of predetermined length.

9. The method of claim 1, wherein the wrapping material is selected from the group consisting of cigarette paper and imitation cork.

10. In a machine for making and/or processing of rod-shaped articles which constitute or form part of smokers' products and wherein at least one envelope of wrapping material surrounds at least one rod-like filler, apparatus for treating the wrapping material comprising at least one pair of electrodes defining at least one spark gap wherein the wrapping material is formed with holes as a result of exposure to sparks and the formation of holes is accompanied by the development of particles of dust and ozone; means defining a closed path which includes said spark gap and is at least substantially sealed from the surrounding atmosphere; a supply of gaseous fluid which fills said path and is effective to oppose the development of ozone; means for circulating the fluid along said path whereby the circulating fluid entrains the particles of dust from the region of said spark gap; and filter means installed in said path to intercept the thus entrained particles of dust so that the fluid which is recirculated into the region of said gap is at least substantially free of dust particles.

11. The apparatus of claim 10, wherein said means which defines said closed path includes a housing having an inlet and an outlet for the wrapping material and a portion of said path extends between said inlet and said outlet, said electrodes extending into said portion of said path and said portion of said path including said spark gap, and further comprising means for transporting the wrapping material through said housing.

12. The apparatus of claim 11, wherein said means which defines said path further includes conduit means defining a second portion of said path which communicates with said portion between said inlet and said outlet of said housing.

13. The apparatus of claim 12, wherein said filter means and said circulating means are installed in said conduit means.

14. The apparatus of claim 11, further comprising means for cooling the fluid in said path so that the fluid which flows toward said spark gap cools the electrodes

15. The apparatus of claim 11, wherein said means which defines said path further comprises conduit means connected with said housing and defining a second portion of said path which is in communication with the path portion between said inlet and said outlet, said circulating means, said filter means and said cooling means being installed in said conduit means.

16. The apparatus of claim 15, wherein said cooling means includes a heat exchanger.

17. The apparatus of claim 11, wherein said housing has internal recesses forming part of said portion of said path and said electrodes have end portions extending into said recesses.

18. The apparatus of claim 17, wherein said means which defines said path further includes conduit means communicating with said recesses.

19. The apparatus of claim 11, further comprising means for sealing said portion of said path from the surrounding atmosphere in the region of said inlet and said outlet.

20. The apparatus of claim 19, wherein said portion of said path includes compartments in the region of said inlet and said outlet and said sealing means includes rotary members installed in said compartments and means for yieldably biasing said rotary members against the wrapping material in said portion of said path as well as against said housing.

21. The apparatus of claim 20, wherein said rotary members are idler rollers which are driven by the wrapping material when the latter is transported through said housing.

22. The apparatus of claim 10, wherein the fluid in said path is a noble gas.

23. The apparatus of claim 22, wherein said noble gas is Argon.

* * * * *